United States Patent [19]

Charvin et al.

[11] 4,250,003

[45] Feb. 10, 1981

[54] PROCESS FOR THE ELECTROLYTIC PREPARATION OF ALKALI METAL CHLORATES

[75] Inventors: Roger Charvin, St. Jean De Maurienne; Jean-Louis Pignan, Grenoble, both of France

[73] Assignee: Produits Chimiques Ugine Kuhlmann, Courbevoie, France

[21] Appl. No.: 91,141

[22] Filed: Nov. 5, 1979

[30] Foreign Application Priority Data

Nov. 14, 1978 [FR] France ..... 78 32089

[51] Int. Cl.[3] ..... C25B 1/14; C25B 1/26

[52] U.S. Cl. ..... 204/098

[58] Field of Search ..... 204/98

[56] References Cited

U.S. PATENT DOCUMENTS

| | | | |
|---|---|---|---|
| 4,115,218 | 9/1978 | Krumpelt | 204/98 |
| 4,116,781 | 9/1978 | Dorio et al. | 204/98 |
| 4,147,599 | 4/1979 | O'Leary et al. | 204/98 |

FOREIGN PATENT DOCUMENTS

| | | | |
|---|---|---|---|
| 781429 | 2/1935 | France | 204/98 |

*Primary Examiner*—Howard S. Williams

*Attorney, Agent, or Firm*—Pennie & Edmonds

[57] ABSTRACT

Improvement in the processes for the manufacture of alkali metal chlorates by electrolysis of alkali metal chlorides characterized by the fact that the temperature of electrolysis is reduced by 30° C. to 50° C. when the voltage of the cell reaches an undesirable level and then reestablishing the normal operating conditions of the cell.

3 Claims, No Drawings

PROCESS FOR THE ELECTROLYTIC PREPARATION OF ALKALI METAL CHLORATES

TECHNICAL FIELD

The present invention relates to an improvement of the manufacture of sodium chlorate by electrolysis, and more particularly, to a means of mitigating the drawbacks caused by the presence of alkaline-earth cations in the electrolyte.

BACKGROUND ART

The industrial manufacture of sodium chlorate is carried out mainly by electrolysis of a sodium chloride solution. The industrial sodium chloride, industrial water and raw materials used during manufacture almost always contain alkaline-earth cations such as calcium and magnesium. Such cations deposit on the cathode; they do so in the carbonate state when graphite anodes are used, and substantially in the hydroxide state when metallic anodes are used. The rate of formation of cathodic crusts increases with increasing operating temperature and increasing current density, which is characteristic of the use of metallic anodes.

These deposits, which have a compact texture, firmly adhere to the cathode. They tend to insulate the cathode electrically, and hence lead to an increase in the total voltage at the terminals of the cell if a constant electrical current density is to be maintained.

Thus, the presence of alkaline-earth cations in the electrolyte used for the preparation of sodium chlorate leads to an increase in specific energy consumption, on the one hand, and to the necessity of subjecting the cathodes and cells to periodic cleaning, on the other, with the frequency of such cleanings increasing with increasing operating temperature and increasing current density.

Such cleanings must be carried out very frequently when anodes consisting of a metallic support and a superficial coating are used; such anodes are of major interest precisely because they make it possible to carry out an electrolysis at a high temperature and high current density.

The technique currently used for carrying out this periodic cleaning of the cathodes consists in stopping the electrolysis, emptying the cells, cleaning the cathodes by acid treatment, rinsing the cell, replacing the electrolyte and restarting the cell. Hence this is an expensive technique due, in particular, to the interruption of operations which it involves.

The acid treatment generally used consists in a treatment with hydrochloric acid, carried out with dilute hydrochloric acid whose concentration is less than 10% by weight, to avoid corrosion of the steel cathodes and other steel components of the cells. The addition of a corrosion inhibitor to the hydrochloric acid bath is recommended.

DISCLOSURE OF THE INVENTION

In the course of investigations relating to the improvement of processes for the preparation of alkali metal chlorates and particularly of sodium chlorate by electrolysis of chlorides with metallic anodes, the applicants have developed a process which makes it possible to prolong the interval between cell cleanings to a considerable extent.

In plants where sodium chlorate is prepared by electrolysis of sodium chloride with metallic anodes, the following operating conditions are generally present:

| | |
|---|---|
| Concentrations of aqueous solutions: | $NaClO_3$ g/l 0 to 700, NaCl g/l 320 to 120 |
| Operating temperature: | 55° C. to 85° C. |
| Operating pH: | 6 to 6.5, generally obtained by addition of HCl |
| Current density $A/m^2$: | 1,500 to 6,000 |
| Cell voltage, volts: | 2.8 to 3.9 |
| Anodes: | Titanium support coated with Pt/Ir, or precious metals, or oxide of precious metals. |

The lines of electrolysis are operated by using conventional methods, with automatic temperature and pH control, the electrical parameters being essentially a function of the type of cell used.

The process developed by the applicants consists in lowering the operating temperature by 30° to 50° C. when the cell voltage reaches a level resulting in an excessively high consumption of electrical energy. These changes in the conditions of electrolysis are effected without interruption of production, by adjustment of the temperature control means.

The choice of voltage at which this treatment is decided upon depends on the particular economic conditions of the plant in question, such as the cost of electrical energy, the cost of production stoppages and the purity of the electrolyte.

The new operating conditions which are generally obtained very rapidly (in 1 or 2 hours) may be immediately abandoned in order to return to the initial conditions, or they may be maintained over a period of time. If, owing to the operating conditions of a given installation, the efficacy of the process of this invention diminishes with time, so that after a certain number of operations the voltage drop obtained is found to be insufficient, it may then be useful to shut down the installation and clean it by conventional methods.

The use of this process offers two essential advantages. First it makes it possible to avoid or at least reduce to a minimum the production stoppages required for cleaning of the cells, stoppages which may last 24 hours and thus entail a substantial loss of production; and second, it limits and periodically reduces the voltage rise due to the cathodic deposit, thereby decreasing the consumption of electrical energy.

This technique is particularly well suited to modern plants where sodium chlorate is prepared by electrolysis in electrolytic cells comprising metallic anodes coated with electroactive layers, e.g., of platinum/iridium or ruthenium oxide, but it is equally suitable for the electrolytic preparation of potassium chlorate and chlorates of alkali metals in general. The electrolysis temperature of such cells is normally between about 60° and 80° C.

BEST MODE FOR CARRYING OUT THE INVENTION

The following example illustrates the process of the invention in a non-limitative manner:

EXAMPLE

The electrolytic production of sodium chlorate is carried out in an industrial cell under the following conditions:

| | |
|---|---|
| Bath composition: | |
| Sodium chloride | 120 g/l |
| Sodium chlorate | 520 g/l |
| Sodium hypochlorite | 1.5 g/l |
| Sodium bichromate | 7 g/l |
| pH of bath | 6.3 |
| Temperature of electrolysis 70° C. at 2,500 amp/m$^2$. | |
| Titanium anode with a coating based on ruthenium dioxide. | |
| Concentration of impurities in the electrolyte entering the cell: Calcium 30 ppm, magnesium 5 ppm. | |

On starting the previously cleaned cell, the voltage is 3.15 volts, and as the cathodes gradually become encrusted the voltage regularly increases and reaches 3.60 volts after 60 days.

In the previously used process, the production was then stopped, the cell emptied and filled with hydrochloric acid solution having a concentration of 20 g/l to which a corrosion inhibitor was added. The solution was left in contact with the cell for 8 hours, after which the cell was emptied and washed with water before restarting the installation. These operations lasted for a total of 12 to 14 hours.

According to the process of the present invention, the installation continues in operation and the temperature of the cell is reduced from 70° C. to 35° C. by adjustment of the temperature control for a period of about 45 minutes. The installation is then immediately returned to the above-indicated initial operating conditions, which requires about 45 minutes. It is then noted that the cell voltage has dropped to 3.20 volts, a value close to the initial voltage, and the cell can again be used for a normal period of operation.

We claim:

1. Improvement in processes for manufacture of alkali metal chlorates by electrolysis of alkali metal chlorides in which the electrolysis solution contains cation impurities which comprises reducing the normal temperature range of about 55° to 85° C., a quantity between about 30° C. and 50° C., while continuing the electrolysis reaction when the voltage reaches an undesirable level to reduce the voltage required during normal operation and then reestablishing the normal operating conditions of the electrolysis.

2. The process of claim 1 in which the alkali metal chlorates is prepared using metallic anodes.

3. The process of claims 1 or 2 in which the alkali metal chloride is sodium chloride.

* * * * *